US005451180A

United States Patent [19]

Chan et al.

[11] Patent Number: 5,451,180

[45] Date of Patent: Sep. 19, 1995

[54] TOY WITH A MOVABLE FIGURE

[75] Inventors: Albert W. T. Chan, Unionville, Canada; Simon K. On Law, Shatin, Hong Kong

[73] Assignee: Thinkway Trading Corporation, Markham, Canada

[21] Appl. No.: 176,648

[22] Filed: Jan. 3, 1994

[51] Int. Cl.[6] ..... A63H 13/00

[52] U.S. Cl. ..... 446/357; 446/360; 40/411

[58] Field of Search ..... 446/358, 357, 360, 71, 446/298, 297, 303, 330, 335, 359, 280–284; 40/411, 414, 417–420; 84/95.2, 94.2

[56] References Cited

U.S. PATENT DOCUMENTS

| | | | |
|---|---|---|---|
| 974,450 | 11/1910 | Tully | 40/419 X |
| 1,109,498 | 9/1914 | Young | 446/357 |
| 1,187,708 | 6/1916 | Carruther et al. | 446/357 X |
| 1,272,304 | 7/1918 | Owens | 40/418 |
| 4,279,098 | 7/1981 | Kulesza et al. | 446/357 X |
| 5,310,375 | 5/1994 | Kanauchi | 446/358 X |

*Primary Examiner*—Mickey Yu
*Attorney, Agent, or Firm*—Brian W. Gray; Carol Miernicki Steeg

[57] ABSTRACT

A toy with movable figures in a toy scene. The toy includes a housing, a scene board with a hole in it mounted in the housing and a movable figure loosely suspended in the hole. The upper body of the figure is larger than the hole and an end of the figure projects downwardly through the hole below the scene board. A spring driven motor is mounted in the housing below the scene board and has a shaft projecting upwardly. The housing contains a covering or a case and the winding of the spring is activated by the opening and closing of the case. An eccentric cam is connected to the shaft of the motor and a cam follower plate moves back and forth below the scene board in response to rotation of the cam. A projection, which may be a ramp, on the upper surface of the cam follower plate contacts the lower end of the figure, causing it to move up and down in the hole. There may be several figures with respective holes and respective ramps on the cam follower. The ramps can be aligned in opposite directions so that, on movement of the cam follower in a first direction, only some of the figures rise in their holes while others fall. Additional figures can be connected to the cam follower such that they move back and forth on the scene board in linear motion. The cam follower can project up through the scene board into the body of an animal figure, so that the rotational motion of the cam can be translated to the head or tail of the animal for further and more realistic movement of a figure in the scene.

12 Claims, 5 Drawing Sheets

TOY WITH A MOVABLE FIGURE

FIELD OF THE INVENTION

This invention relates to toys and in particular to toys having movable figures activated by motors, particularly spring wound motors.

BACKGROUND OF THE INVENTION

Children are fascinated by toys which have figures that move in lifelike ways. Lifelike movement is improved if the activating force moving the figures is not immediately apparent and if the figures can be made to move in a less mechanical way.

In addition, because of the economics of developing toys, it is helpful if the mechanism can be as simple as possible.

The present invention is particularly suited to scenes, particularly scenes which have small animals or figures moving in them.

The invention can also be used with a spring driven motor, and the scenes can be encased in a case such as an egg which, when opened, can reveal the scene.

If the opening or the closing of the case also winds the motor, the figures can be made to move by the opening and closing of the case.

Scenes driven by spring motors that are wound by the opening and closing of an egg-like case are known. An example of such product was made in 1993 by Takara Co. Ltd. under the name of My Pet Dino. Typically, such scenes are additionally encased in a clear plastic bubble to protect the moving figures, even when the outer opaque case is open.

In the Takara example, the closing of the case winds the spring driven motor, which has an eccentric cam attached to its shaft. The eccentric cam extends upward through a scene board into the underside of a figure which then moves side to side in response to the movement of the eccentric cam.

The present invention seeks to improve on this article by providing for a different form of motion which can be applied to a plurality of individual figures and can be combined with other figures to create relatively complex moving animated scenes driven by a spring driven motor.

SUMMARY OF THE INVENTION

The present invention thus provides a toy with a movable piece comprising a housing, a scene board mounted in the housing having through it a hole, a movable piece having an upper part larger than the hole and loosely fit in the hole with an end projecting downwardly through the hole below the scene board. In a preferred embodiment described in detail below, the movable piece is a figure. A motor is mounted in the housing below the scene board and has a shaft projecting upwardly. Means are provided for powering the motor. Typically the motor will be a spring driven motor and there will be means for winding the spring. Further and preferably, the housing contains a covering or a case and the winding of the spring is activated by the opening and closing of the case.

The toy further contains a cam connected to the shaft of the motor and off centred from the axis of rotation of the shaft for eccentric movement of the cam, and a cam follower plate contacting the cam and movably mounted below the scene board for back and forth movement of the cam follower in response to the cam.

A projection is provided on the upper surface of the cam follower plate to contact the end of the piece during movement of the cam follower to move the piece in the hole.

In another aspect of the invention and preferably, the projection is a ramp. Preferably there are a plurality of holes and a plurality of pieces, one in each hole, and there is a ramp on the cam follower associated with each piece and hole. In this embodiment, the ramps can be aligned in opposite directions so that, on movement of the cam follower in a first direction, only some of the pieces rise in the hole while others fall.

Since the pieces are loosely fit in their respective holes, their movement is not entirely tied to the cam follower. They rise in response to the bumps, projections or ramps on the surface of the cam follower and fall because of gravity. However, because of friction and other factors (including the lack of precise manufacturing of small plastic parts), the pieces do not fall necessarily in a uniform or even rate and the movement of the pieces in the holes does not look entirely mechanical.

Further, by the provision of a movable cam follower below the scene board, it is possible to connect other pieces to the cam follower, thus allowing such pieces to move back and forth on the scene board in linear motion. Additionally, if the cam follower projects up through the scene board into the body of an animal, the rotational motion of the cam can be translated to a tail or head of an animal for further and more realistic movement of a piece or animal in the scene.

These and other features of the invention will become apparent from the description below.

DETAILED DESCRIPTION OF THE INVENTION

Figure 5:
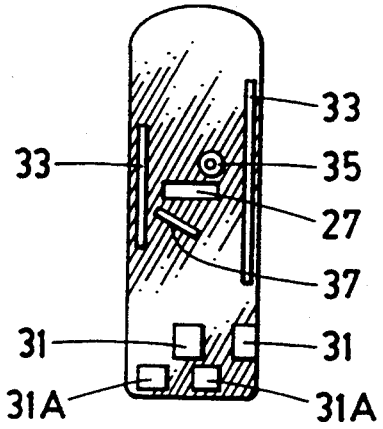
FIG. 5 is a top view of the cam follower of this toy.

In one preferred embodiment the invention comprises an egg shaped housing 1. And further, egg case 3 is provided having hinged cover parts 5 and 7. Contained in the egg housing 1 is a spring driven motor and gear box 9 of conventional manufacture having mounted on its shaft a cam 11 which is eccentrically mounted in relation to the shaft of the motor so as to describe circle on rotation. A base plate 13 is also mounted in the housing 1 and it contains an aperture 15 slightly larger than the circle described by the eccentric cam and through which the cam 11 projects. Further apertures 17 serve to index the motor location on the base plate. Aperture 19 and an additional aperture on the other side (not shown) provide passageways for screws 21 which connect through the base plate to scene board 23. Movably mounted above the base plate is cam follower plate 25. Cam follower 25, as best seen in FIG. 5, contains a rectangular hole 27 through which the cam 11 projects. The rotational movement of the cam 11 is translated into back and forth linear movement of cam follower 25 when the cam contacts the sides of the rectangular aperture 27. The cam follower is guided by guide means 29 on the base plate 13. The cam follower 25 has four ramps 31 and 31A projecting from its upper surface, as can also be seen in FIGS. 5 and 6. In addition the cam follower has spacer ridges 33 for maintaining space between the scene board 23 and for ease of sliding of the follower 25 over the undersurface of board 23. A raised socket 35 and a raised projection 37 are also provided on the upper surface of the follower 25, the purpose of which will be more fully described later.

Figure 3:
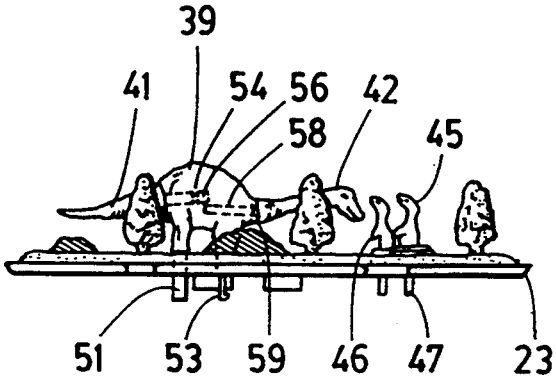
FIG. 3 is a side view of the same scene board.
Figure 4:
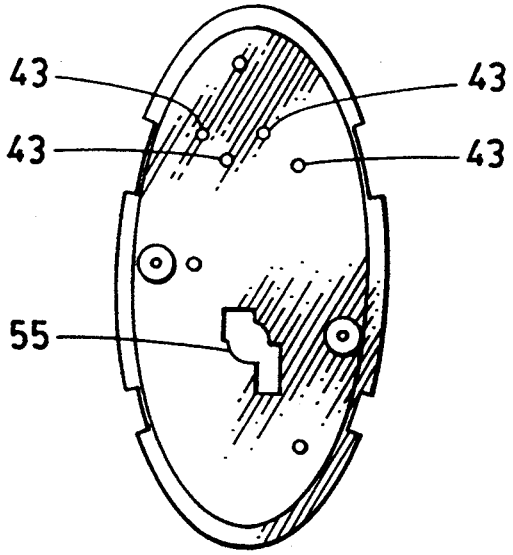
FIG. 4 is a bottom view of the scene board.

The scene board 23 contains a dinosaur FIG. 39 having a movable tail 41 and head/neck 42. In addition the scene board has a series of holes 43, as best seen in FIG. 4. Baby dinosaur FIGS. 45 in these holes are suspended, as best seen in FIG. 3. The dinosaur figures have arms 46 which prevent their upper bodies from falling through the holes. Below the arms 46 the bodies are slender enough to fit loosely in the holes 43. The baby dinosaur FIGS. 45 have ends 47 projecting below the undersurface of scene board 23. When assembled, the ends 47 contact the ramps 31 upon movement of the cam follower 25, with the result that baby dinosaurs 45 are forced upwardly in the holes 43 when the upper portion of the ramp is moved into position below each end. The FIGS. 45 drop naturally by gravity back into their holes as the ramp surface of cam follower 25 moves away from the end 47.

In addition, because the dinosaur babies 45 are not tightly fit in the holes 43, there is side to side movement of the figures as well as up and down movement as the ramps move into and out of position below the end 47.

Figure 6:
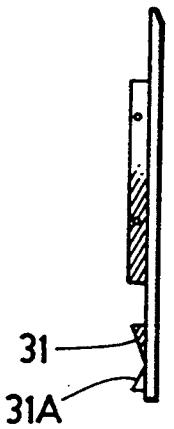
FIG. 6 is a side view of the same cam follower.
Figure 7:
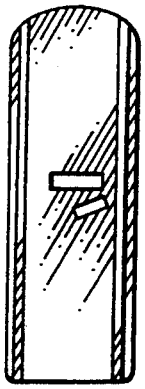
FIG. 7 is a bottom view of this cam follower.
Figure 8:
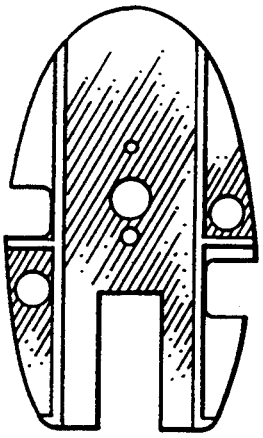
FIG. 8 is a top view of the base plate attached to the egg.
Figure 9:
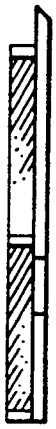
FIG. 9 is a side view of the base plate.
Figure 10:
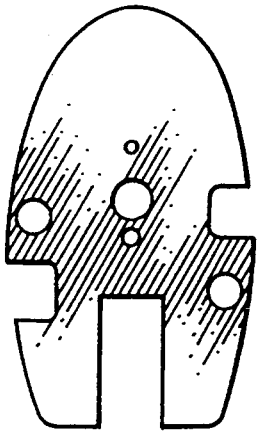
FIG. 10 is a bottom view of the same plate.

As can be seen in FIGS. 5 and 6, ramps 31 do not all slope the same way. Two ramps 31 are sloped in one direction and two other ramps 31A are sloped in the opposite direction, so that the FIGS. 45 do not all rise and fall at the same time.

Figure 14:
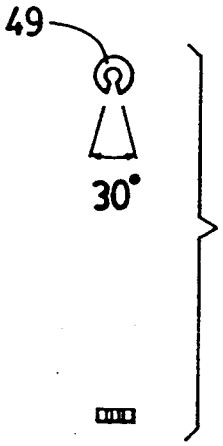
FIG. 14 is a clip for retaining certain figures on the scene board.

In order to prevent the FIGS. 45 from falling entirely out of their holes if the scene board 23 is turned upside down, retaining clips 49, as shown in FIG. 14, are inserted on the ends 47 of the FIGS. 45. The clips are not shown attached to the ends in FIG. 3. They are attached, however, with sufficient clearance so that they do not obstruct the upward movement of the FIGS. 45 in response to the ramps 31 or 31A.

The dinosaur 39, as best seen in FIG. 3, has projecting from its left hind leg a pin 51 which is inserted into the socket 35 on the cam follower 25. Projecting from the right foreleg of the dinosaur is a retaining clip 53 which fits under the raised portion 37 to mount the dinosaur on the cam follower. It will thus be appreciated that the dinosaur moves back and forth on the scene board 23 in response to the back and forth movement of the cam follower 25 on which it is mounted.

In addition the cam 11 projects through the base plate 13, the rectangular aperture 27 in the cam follower 25 and aperture 55 (seen in FIG. 4) in the scene board 23, through a hole of the belly of the dinosaur 39 (not shown), and finally into a hole 54 (shown inside the dinosaur on FIG. 3) on the end of the tail 41. The rotation of the cam 11, in addition to moving the cam follower 25 in linear motion back and forth, also provides eccentric rotational motion to end 56 of the tail 41 contained inside the dinosaur 39, with the result that the tail 41 "wags" as it pivots in a substantially horizontal plane. The internal end 56 of the tail 41 touches end 58 of head and neck 42 which is sloped from one side of the dinosaur to the other (not shown), causing the end 58 to rise and fall. The result is that the head and neck pivots about point 59 and appears to nod up and down in response to the wagging of the tail 41.

Thus the winding of the spring driven motor and gear box 9 causes rotational movement of the cam 11 and movement of the cam follower 25, with the result that the dinosaur 39 moves back and forward towards the babies 45 while wagging its tail 41 and nodding its head 42. At the same time, the babies 45 rise and fall and rock or nod in the holes 43, thus creating a realistic scene. The motor and gear box 9 are wound by means of string 60 which is wound onto a pulley 61 contained on the underside of the motor 9 opposite the cam 11. The closing of the egg case cover 5 results in a movement of an actuator piece 75 through aperture 62 in the egg housing 1. The actuator piece 75 contacts the string 60 causing it to extend and wind the pulley 61, thus winding up the motor 9. When the egg housing 5 is opened, the motor is free to unwind, thus actuating the motor 9 and the cam follower 11 and initiating movement of the scene on the scene board 23.

The egg cover parts 5 and 7 are latched together by a clip 63 and are retained in an open position by springs 65 mounted on a shaft 67.

Figure 1:
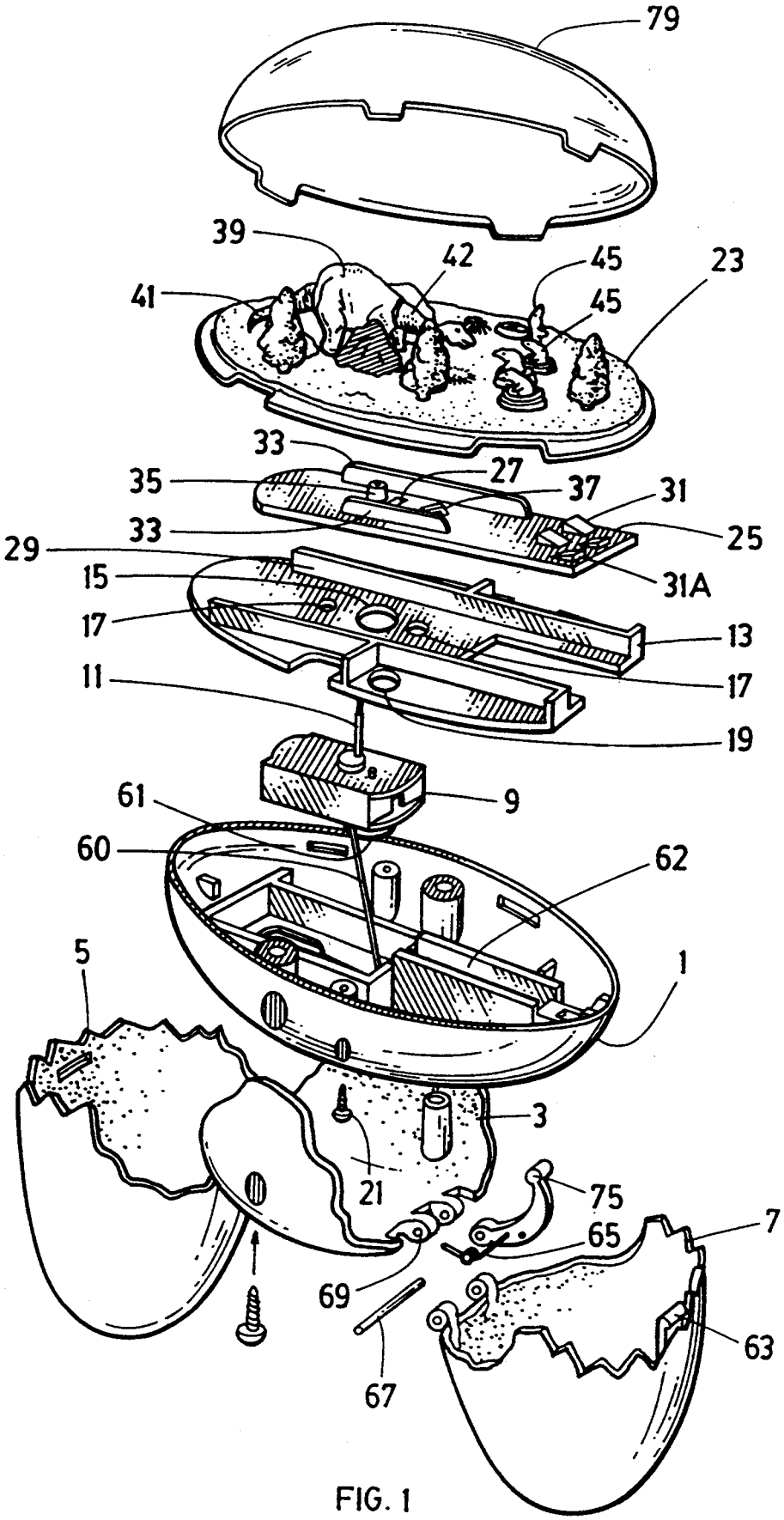
FIG. 1 is an exploded view of one toy embodying this invention representing a dinosaur scene inside a dinosaur egg case.
Figure 2:
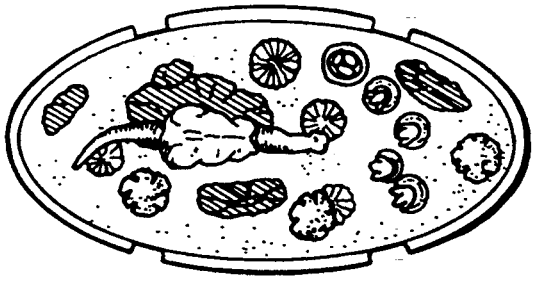
FIG. 2 is a top view of the scene board of this toy.
Figure 11:
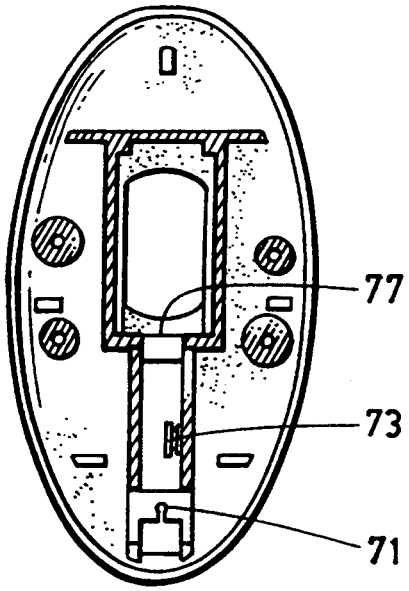
FIG. 11 is a top view of the bottom portion of the egg housing.
Figure 12:
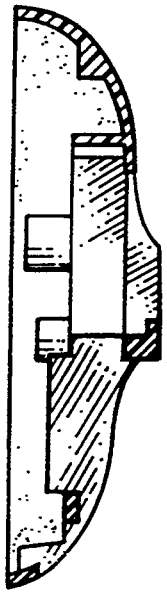
FIG. 12 is a section of this housing along the line AA in FIG. 11.
Figure 13:
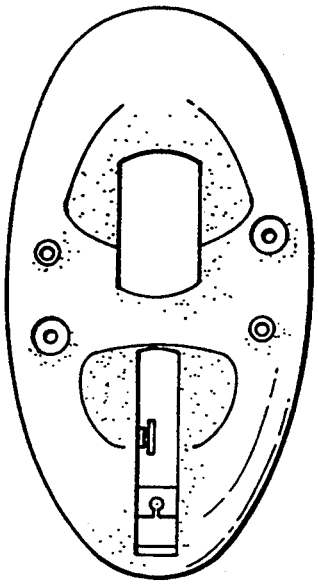
FIG. 13 is a bottom view of the egg.

The string 60 is not actually positioned as shown in FIG. 1 in operation and assembled. In fact, the end of the string is fixed by a small knot to notch 71 which can be seen in FIG. 11 and which extends across spreader 73 so that the actuator 75 pushes the string at the point between the spreader 73 and an end of housing 77 to wind the motor.

The scene board 23 also includes a clear cover 79 which is useful to protect the small figures frown damage.

Although the preferred embodiment has been shown with dinosaur figures, it would be appreciated that the invention can be adapted to dinosaurs, toy animals, human figures or any moving piece. Further, the case does not need to be egg shaped but can be any convenient shape. In certain circumstances there need not be a case at all.

While a spring driven motor that is self-actuated by the opening and closing of the case are preferable, the motor could be hand wound or driven by electricity. While it will be understood that the foregoing disclosed embodiment is illustrative of the invention, modifications thereto can be made within the scope of the claims appended hereto.

What is claimed is:

1. A toy with movable figure comprising:

(i) a housing;

(ii) a scene board mounted on the housing and having through it a hole;

(iii) a movable figure having an upper body part larger than the hole, loosely fit in the hole having an end projecting downwardly through the hole below the scene board;

(iv) a motor mounted in the housing below the scene board and having a shaft projecting upwardly;

(v) means powering the motor;

(vi) a cam connected to the shaft and off centred from the axis of rotation of the shaft for eccentric movement of the cam;

(vii) a cam follower plate contacting the cam and movably mounted below the scene board for back and forth movement in response to the cam;

(viii) a projection on the upper surface of the cam follower plate to contact the end of the figure during the movement of the cam follower to move the movable figure in the hole; and (ix) and additional figure placed on the scene board and mounted on the cam follower plate through a hole in the scene board for movement with a cam follower plate and relative movement of the scene board.

2. The toy of claim 1 in which there are a plurality of holes in the scene board and a plurality of movable figures having ends projecting downwardly, one end of a movable figure in each hole, and in which there are a plurality of projections on the cam follower, one projection associated with each end.

3. The toy of claim 2 in which at least one of the projections is a ramp for raising the movable figure in the hole.

4. The toy of claim 2 in which each of the plurality of projections is a ramp for raising the respective movable figure in its respective hole and in which some of the ramps are aligned in a first direction in relation to the movement of the cam follower in a first direction and the other of the ramps are aligned in a second direction in relation to the movement of the cam follower in a second direction so that at least some of the movable figures do not rise and fall together.

5. The toy of claim 1 in which the cam projects through the cam follower plate and scene board and in which the additional figure has a part movable in response to the movement of the cam.

6. The toy of claim 5 in which the part is a tail.

7. The toy of claim 5 in which the part is a head.

8. The toy of claim 5 in which the housing is contained within a case and the motor is a spring driven motor having means for winding the motor which is activated by the opening and closing of the case.

9. The toy of claim 8 in which the case is of an egg-shape and in which the scene board is enclosed in a clear plastic bubble within the egg-shaped case.

10. A toy with a movable piece comprising:

(i) a housing;

(ii) a scene board mounted on the housing and having through it a hole;

(iii) a movable piece having an upper part larger than the hole, loosely fit in the hole and having an end projecting downwardly through the hole below the scene board;

(iv) a motor mounted in the housing below the scene board and having a shaft projecting upwardly;

(v) means powering the motor;

(vi) a cam connected to the shaft and off centred from the axis of rotation of the shaft for eccentric movement of the cam;

(vii) a cam follower plate contacting the cam and movably mounted below the scene board for back and forth movement in response to the cam;

(viii) a projection on the upper surface of the cam follower plate to contact the end of the movable piece during the movement of the cam follower to move the movable piece in the hole; and (ix) an additional piece placed on the scene board and mounted on the cam follower plate through a hole in the scene board for movement with the cam follower plate and relative movement on the scene board.

11. The toy of claim 10 in which the cam projects through the cam follower plate and scene board and in which the additional piece has a part movable in response to the movement of the cam.

12. The toy of claim 10 in which there are a plurality of holes in the scene board and a plurality of movable pieces having ends projecting downwardly, one end of a piece in each hole, and in which there are a plurality of projections on the cam follower, one projection associated with each end.

* * * * *

UNITED STATES PATENT AND TRADEMARK OFFICE

CERTIFICATE OF CORRECTION

PATENT NO. : 5,451,180

DATED : September 19, 1995

INVENTOR(S) : Alberta Wai Tai Chan and Simon Kai On Law

It is certified that error appears in the above-identified patent and that said Letters Patent is hereby corrected as shown below:

In column 3, line 23 of the Patent change "FIG. 39" to -- figure 39 --;

In column 3, line 26 of the Patent change "FIGS. 45" to -- figures 45 --;

In column 3, line 31 of the Patent change "FIGS. 45" to -- figures 45 --;

In column 3, line 37 of the Patent change "FIGS. 45" to -- figures 45 --;

In column 3, line 47 of the Patent change "FIGS. 45" to -- figures 45 --;

In column 3, line 49 of the Patent change "FIGS. 45" to -- figures 45 --;

In column 3, line 52 of the Patent change "FIGS. 45" to -- figures 45 --;

In column 3, line 55 of the Patent change "FIGS. 45" to -- figures 45 --;

Signed and Sealed this

Twenty-sixth Day of March, 1996

Bruce Lehman

*Attest:*

BRUCE LEHMAN

*Attesting Officer*

*Commissioner of Patents and Trademarks*